US005172825A

United States Patent [19]

Clay

[11] Patent Number: 5,172,825

[45] Date of Patent: Dec. 22, 1992

[54] STORAGE OF A REFINED LIQUID HYDROCARBON PRODUCT

[75] Inventor: Carl D. Clay, Findlay, Ohio

[73] Assignee: Marathon Oil Company, Findlay, Ohio

[21] Appl. No.: 245,083

[22] Filed: Sep. 15, 1988

Related U.S. Application Data

[63] Continuation-in-part of Ser. No. 43,676, Apr. 28, 1987, abandoned.

[51] Int. Cl.[5] ..... B65D 90/00; C08K 39/00

[52] U.S. Cl. ..... 220/565; 524/555

[58] Field of Search ..... 228/1 B; 220/565; 524/555

[56] References Cited

U.S. PATENT DOCUMENTS

| | | | |
|---|---|---|---|
| 2,899,820 | 8/1959 | Hendrick | 220/1 B |
| 4,664,294 | 5/1987 | Hetherington | 220/1 B |
| 4,683,949 | 8/1987 | Sydansk | 524/555 |

FOREIGN PATENT DOCUMENTS

| | | | |
|---|---|---|---|
| 1082703 | 3/1984 | U.S.S.R. | 220/1 B |

*Primary Examiner*—Joseph L. Schofer
*Assistant Examiner*—Peter D. Mulcahy
*Attorney, Agent, or Firm*—Jack L. Hummel; Jack E. Ebel

[57] ABSTRACT

A process for storing a refined liquid hydrocarbon product in a storage tank having a dead volume. The process comprises filling the dead volume with a rigid crosslinked polymer gel and storing product in the remaining internal volume of the storage tank.

12 Claims, 1 Drawing Sheet

STORAGE OF A REFINED LIQUID HYDROCARBON PRODUCT

DESCRIPTION

The present application is a continuation-in-part application of U.S. patent application Ser. No. 07/043,676 now abandoned filed on Apr. 28, 1987 to the same inventor.

BACKGROUND OF THE INVENTION

1. Technical Field

The invention relates to a process for storing a refined liquid hydrocarbon product and more particularly to a process for storing a refined liquid hydrocarbon product in a tank.

2. Background Information

Liquid hydrocarbon product from a refinery is typically distributed to regional terminals for storage and distribution to local markets. Large above-ground storage tanks are the most common means for storing product at the terminals.

Above-ground storage tanks usually have an outlet port in their sidewall to enable withdrawal of liquid product from the tank. However, the position of the outlet port can create a dead volume in the internal tank volume extending from the level of the port down to the bottom of the tank. Although this dead volume can beneficially accumulate contaminants which settle to the bottom of the tank, such as water, the dead volume can also contain useful product. The product in the dead volume is effectively unusable because it is difficult to recover. As a result, the tank operator incurs high inventory carrying costs.

The only practical means for recovering the product accumulated in the dead volume is to slowly pump it out through specially connected auxiliary pumping equipment. Nevertheless, even this procedure is operationally difficult. For this reason, the product occupying the dead volume is usually left in place when emptying the tank of stored product.

A need exists for a process of storing a refined liquid hydrocarbon product in a storage tank which effectively utilizes the entire tank storage volume without losing product to tank dead volume. A need further exists for a process of storing a refined liquid hydrocarbon product in a storage tank which enables one to store the product in the tank or withdraw the stored product from the tank without contamination of the product.

SUMMARY OF THE INVENTION

The present invention provides a process for storing a refined liquid hydrocarbon product in a storage tank. The process enables one to substantially reduce or eliminate the dead volume which may exist in the internal tank volume between the level of the outlet port and the tank bottom. Thus, the practitioner can store product in the tank without loss of product to the dead volume and the practitioner can regularly withdraw substantially all of the product from the tank without contamination from contaminants settled in the bottom of the tank.

The process is practiced by preparing a flowing polymer gelation solution which can be readily placed in the dead volume of the storage tank. The gelation solution comprises a crosslinkable polymer, a crosslinking agent, and an aqueous solvent. The gelation solution is placed in the tank dead volume and gels therein to form a rigid crosslinked polymer gel which effectively eliminates the dead volume from the bottom of the tank by raising the bottom of the tank to the level of the outlet port. One can then resume use of the tank for its storage function.

The mature gel is substantially immiscible and inert in the liquid product being stored in the tank. Thus, the product may be stored in the tank indefinitely without significant risk of gel degradation or contamination from the gel. If one subsequently desires to remove the gel from the tank, this can be accomplished by contacting the gel with a chemical agent which degrades the gel to a flowing solution.

The process has an added benefit in that the gel layer at the bottom of the tank provides protection from tank leakage. If the base of the tank develops leaks due to severe rust or corrosion, the gel will act as the primary containment means to prevent product loss.

DESCRIPTION OF A PREFERRED EMBODIMENT

Figure 1:
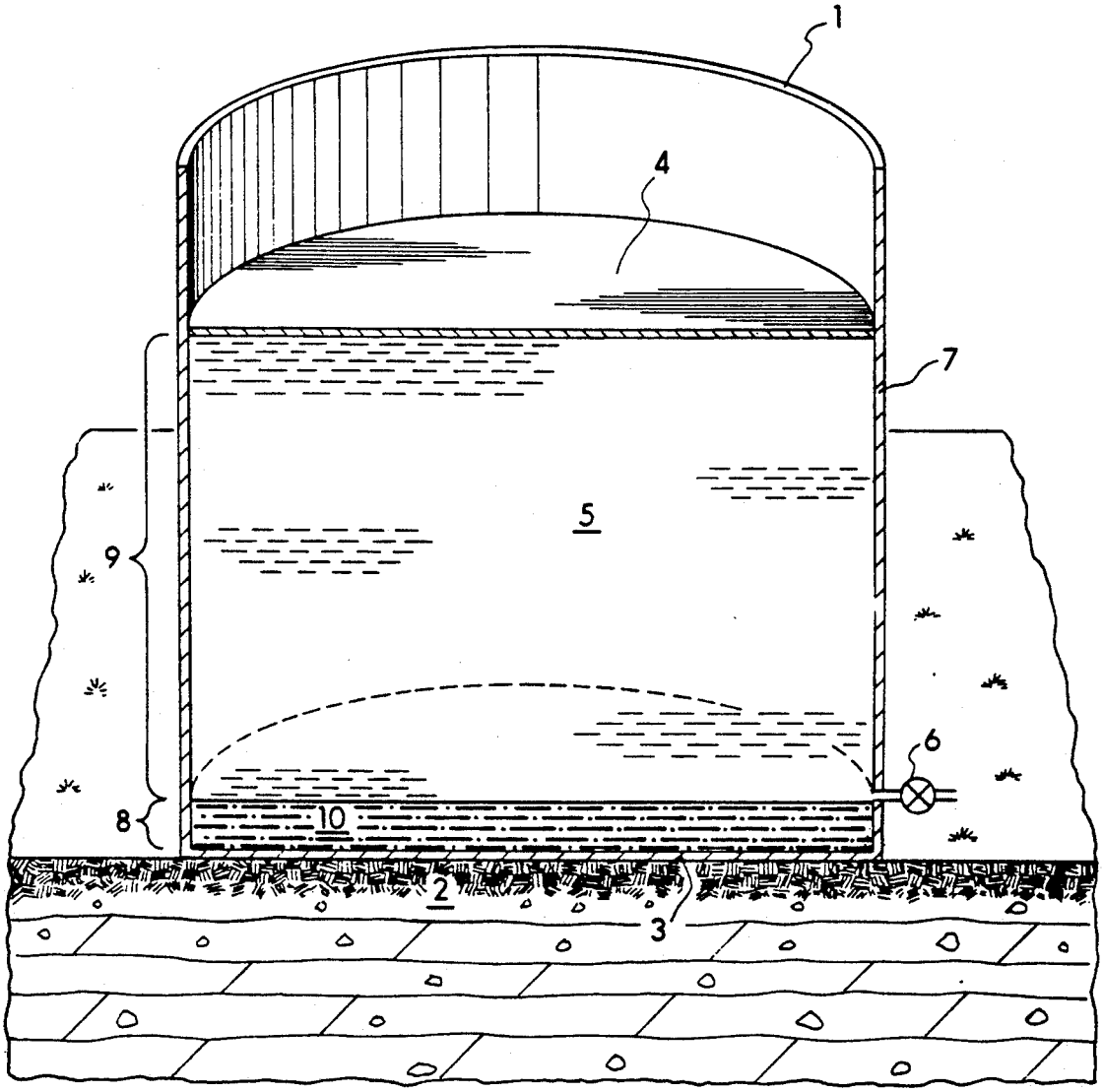
FIG. 1 shows a conceptual conventional refined liquid hydrocarbon product storage tank having a dead volume which is occupied by a rigid polymer gel according to the present invention.

The present invention is a process for storing a refined liquid hydrocarbon product in a conventional product storage tank such as those found at a product distribution terminal. The process employs a crosslinked polymer gel to eliminate the dead volume at the bottom of the tank and to enable more effective utilization of the tank. The invention is described in detail below with reference to FIG. 1.

A conventional product storage tank 1 is typically cylindrically shaped with its axis aligned perpendicular to the ground 2. The enclosed bottom end 3 of the tank is stationary and rests upon the ground while the top end of the tank is in most cases covered with a floating roof 4 which moves up or down with the level of the liquid product 5 in the tank. The nominal volume of the tank 1 is generally in a range between about 10,000 barrels (1,600 $m^3$) and about 500,000 barrels (79,000 $m^3$). The height of the tank is generally between about 20 feet (6.0 m) and about 48 feet (14.4 m).

The tank 1 has an outlet port 6 in its sidewall 7 usually in the form of a valve which enables withdrawal of the stored product 5 from the tank. The outlet port 6 is normally positioned above the tank bottom 3. The height of the outlet port 6 is usually between about 0.5 feet (0.15 m) and about 3 feet (0.91 m) above the tank bottom and preferably about 2 feet (0.61 m) above the tank bottom. The exact height of the outlet port 6 is predetermined as a function of its size and the strength of its reinforcing plate.

The position of the outlet port 6 above the tank bottom 3 results in a dead volume 8 in the internal tank volume. The dead volume 8 is the portion of the internal tank volume extending downward in the tank from the level of the port 6 to the tank bottom 3. This dead volume usually comprises from about 1% to about 6% of the internal tank volume. The remainder of the internal tank volume is termed the "tank storage volume" 9.

The internal tank volume below the outlet port 6 is termed the "dead volume" 8 because liquids cannot be recovered from it via the outlet port 6 using only gravitational forces. Some other means, such as use of special nozzles and pumps, is required to recover liquids from the dead volume 8 of the tank.

The present invention is practiced by filling the dead volume 8 with a gelation solution which matures to a rigid gel 10. The term "gel" as used herein is a continuous three-dimensional solid crosslinked polymeric network, having an ultra high molecular weight. The gel has sufficient structure so that it is substantially rigid under ambient temperature and pressure conditions encountered in the tank during product storage.

The gel 10 of the present invention is sufficiently strong to resist substantial mixing or deformation when the refined liquid hydrocarbon product 5 is placed in the tank or withdrawn from it. Furthermore, the gel 10 is advantageously inert, i.e., unreactive, with the refined liquid hydrocarbon product 5 stored in the tank and is immiscible in it as well. Thus, the gel 10 is substantially incapable of comingling with or contaminating the liquid product 5 by mixing, reacting, dissolving, or other means.

The gel utilized in the present invention comprises a carboxylate-containing polymer, a crosslinking agent, and an aqueous solvent. The carboxylate-containing polymer may be any crosslinkable, high molecular weight, synthetic polymer or biopolymer containing one or more carboxylate species. The average molecular weight of the carboxylate-containing polymer is in the range of about 10,000 to about 50,000,000 and preferably about 100,000 to about 20,000,000 and most preferably about 200,000 to about 15,000,000.

Biopolymers useful in the present invention include polysaccharides and modified polysaccharides. Exemplary biopolymers are xanthan gum, guar gum, carboxymethylcellulose, o-carboxychitosans, hydroxyethylcellulose, hydroxypropylcellulose, and modified starches. Useful synthetic polymers include inter alia acrylamide polymers, such as polyacrylamide, partially hydrolyzed polyacrylamide, copolymers containing acrylamide, and terpolymers containing acrylamide, acrylate, and a third species.

Acrylamide polymers are preferred in the practice of the present invention. As defined herein, an acrylamide polymer is any polymer comprising, at least in part, acrylamide groups. Polyacrylamide is an acrylamide polymer having substantially less than 1% of the acrylamide groups in the form of carboxylate groups. Partially hydrolyzed polyacrylamide is an acrylamide polymer having at least 1%, but not 100% of the acrylamide groups in the form of carboxylate groups. The acrylamide polymer may be prepared according to any conventional method known in the art, but preferably has the specific properties of acrylamide polymer prepared according to the method disclosed by U.S. Pat. Re. No. 32,114 to Argabright et al incorporated herein by reference.

The crosslinking agent can generally be substantially any composition, including compounds, ions, radicals or complexes, capable of crosslinking the polymer to form the above-described gel network. Useful crosslinking agents include compositions containing polyvalent transition metal cations, such as iron, aluminum, or chromium. A preferred crosslinking agent is a chromic carboxylate complex.

The term "complex" is defined herein as an ion or molecule containing two or more interassociated ionic, radical or molecular species. A complex ion as a whole has a distinct electrical charge while a complex molecule is electrically neutral. The term "chromic carboxylate complex" encompasses a single complex, mixtures of complexes containing the same carboxylate species, and mixtures of complexes containing differing carboxylate species.

The chromic carboxylate complex of the present invention includes at least one or more electropositive chromium III species and one or more electronegative carboxylate species. The complex may advantageously also contain one or more electronegative hydroxide and/or oxygen species. It is believed that, when two or more chromium III species are present in the complex, the oxygen or hydroxide species may help to bridge the chromium III species. Trivalent chromium and chromic ion are equivalent terms encompassed by the term chromium III species as used herein.

Each complex optionally contains additional species which are not essential to the polymer crosslinking function of the complex. For example, inorganic mono- and/or divalent ions, which function merely to balance the electrical charge of the complex, or one or more water molecules may be associated with each complex. Representative formulae of such complexes include:

$[Cr_3(CH_3CO_2)_6(OH)_2]^{+1}$;

$[Cr_3(OH)_2(CH_3CO_2)_6]NO_3.6H_2O$;

$[Cr_3(H_2O)_2(CH_3CO_2)_6]^{+3}$;

$[Cr_3(H_2O)_2(CH_3CO_2)_6](CH_3CO_2)_3.H_2O$; etc.

The carboxylate species are advantageously derived from water-soluble salts of carboxylic acids, especially low molecular weight mono-basic acids. Carboxylate species derived from salts of formic, acetic, propionic, and lactic acids, substituted derivatives thereof and mixtures thereof are especially preferred. The carboxylate species include the following water-soluble species: formate, acetate, propionate, lactate, substituted derivatives thereof, and mixtures thereof. The optional inorganic ions include sodium, sulfate, nitrate, and chloride ions.

The aqueous solvent is any aqueous liquid which does not diminish the ability of the gel to perform according to the requirements of the present invention. Possible solvents include distilled water, fresh water, sea water, or oil field brines. Fresh water is usually preferred.

The gel is prepared by admixing the gel components to form a flowing gelation solution. Admixing the gel components broadly encompasses inter alia premixing the components in bulk prior to conveying the solution into the tank, simultaneously mixing the components while conveying them into the tank, or sequentially conveying the components into the tank and mixing them in situ to form the solution. Premixing the components before conveying them into the tank is the preferred method of admixing them because it ensures uniform mixing and optimum gel formation.

The relative concentrations of components in the gelation solution are broadly defined as follows. The polymer concentration in the gelation solution generally is in a range of about 500 ppm up to the solubility limit of the polymer in the solvent or the rheological constraints of the polymer solution, preferably about 1,000 ppm to about 200,000 ppm, and most preferably about 3,000 ppm to about 100,000 ppm. The weight ratio of polymer to crosslinking agent comprising the gelation solution is generally about 1:1 to about 500:1, preferably about 2.5:1 to about 100:1, and most preferably about 5:1 to about 40:1.

A gelation solution is advantageously prepared which has a gelation rate sufficiently slow to enable placement of the gelation solution in the tank as a flowing liquid before the solution sets up. Too rapid a gelation rate can result in a solution which is difficult to place in the tank due to its rheological properties. However, the gelation rate should be sufficiently rapid to enable completion of the gelation reaction within a reasonable period of time after the solution is placed in the tank.

One skilled in the art can select values for all the relevant independent process parameters to obtain a gel meeting the requirements of the present process. Relevant parameters can include, in addition to component concentrations, the actual species of the polymer and crossslinking agent, the molecular weight of the polymer, and the pH and temperature conditions of gelation.

After preparation of an appropriate gelation solution, a volume of the solution is conveyed into the dead volume 8 of the tank. The solution can be conveyed by means such as pumping it through the outlet port 6 of the tank or any other means of access to the tank 1. The volume of the gelation solution which is placed in the dead volume 8 of the tank is sufficient to produce a gel 10 having a volume substantially equal to the dead volume 8 of the tank.

The storage tank 1 does not require any substantial preparation prior to placing the gelation solution in it. However, in some cases gel placement is facilitated by emptying the tank storage volume 9 of liquid product 5 before placing the gelation solution in the tank 1. It may be desirable to allow the aqueous contaminants to remain in the dead volume 8. If one accounts for these aqueous contaminants when preparing the gelation solution, they will dissolve in the water-soluble gelation solution and become incorporated into the resulting solid gel 10. This obviates the need to remove the aqueous contaminants before placement of the gelation solution.

Alternatively, it may be desirable to empty the dead volume 8 as well as the storage volume 9 before placement of the gelation solution. It may also be possible to facilitate placement of the gelation solution by rinsing, cleaning, or otherwise treating the internal tank surface beforehand.

Once the gelation solution is placed in the dead volume 8 of the tank, it preferably sets up therein to form a rigid gel 10. However, the tank outlet port 6 should remain substantially free of the rigid gel 10 so that the gel 10 does not prevent the addition of stored liquid product 5 to the tank 1 or the withdrawal of product 5 from the tank 1.

The gel 10 advantageously cures to full maturity, i.e., complete gelation, before the tank 1 is returned to liquid product storage operation. Gel curing may be enhanced by increasing the temperature above ambient or increasing the pH above neutral of the gelation solution. However, a gelation solution is preferred which matures to a rigid gel without requiring significant pH or temperature modification.

The storage tank 1 is returned to operation with the mature gel 10 occupying the dead volume 8 in the tank and a refined liquid hydrocarbon product 5 occupying the tank storage volume 9. Refined liquid hydrocarbon products 5 are defined herein as refined fractions of crude oil which are liquid at ambient temperature and pressure. Products, such as gasoline, diesel, kerosene, fuel oil, heating oil, aviation fuel, etc., are typically stored at distribution terminals in the manner of the present invention.

The term "contaminants" as used herein includes any non-hydrocarbon which is entrained in the product 5, but which is heavier than the product 5. Thus, contaminants tend to settle out of the product 5 during prolonged storage. Water is the most common product contaminant because it is present to some degree in virtually all refined products. Other contaminants can include solid sediment.

The present process reduces the ability of contaminants to concentrate over time in the bottom 3 of the tank because the tank dead volume 8 is eliminated and the amount of contaminants which can accumulate at the level of the outlet port 6 immediately above the gel 10 is small if product 5 is withdrawn from the tank at frequent intervals. Thus, the present process reduces the risk of product contamination by significant quantities of accumulated contaminants.

In the event that significant quantities of contaminants accumulate at the level of the outlet port 6 due to infrequent product withdrawal, the present process enables one to withdraw the settled contaminant off first by gravity via the outlet port 6. The contaminant can then be discarded or treated and uncontaminated product 5 can be separately withdrawn from the tank 1. Thus, the present process obviates the risk of product contamination even in the presence of accumulated contaminants.

The present process enables retention of the rigid gel 10 in the tank 1 indefinitely without substantial degradation by the liquid product 5 or displacement during normal tank operation. Thus, placement of the gel 10 in the tank 1 may be effectively permanent.

If it is only desired to retain the gel 10 in the tank 1 for a temporary finite time period, the gel 10 can be removed at the end of the time period by either chemical, physical, or thermal degradation, although chemical degradation is preferred. The gel 10 is chemically degraded by contacting it with a concentrated solution of a conventional oxidant such as hydrogen peroxide or sodium hypochlorite. Hydrogen peroxide is the preferred oxidant.

The following example demonstrates the practice and utility of the present invention, but is not to be construed as limiting the scope of the invention.

EXAMPLE

An above-ground cylindrical steel storage tank at a product distribution terminal has an internal volume of 100,000 barrels (16,000 $m^3$) and is 48 feet (14.6 m) high. The tank has an outlet port in the form of a valve about 2 feet (0.61 m) above the tank bottom which rests on the ground. The port creates a dead volume of about 4180 barrels (668 $m^3$) which is about 4.2% of the internal tank volume.

It is desired to remove this dead volume from the tank which is used to store gasoline. Therefore, the gasoline is drained from the tank. An aqueous gelation solution is prepared by mixing a chromic acetate complex crosslinking agent with an aqueous partially hydrolyzed polyacrylamide solution. The molecular weight of the polymer is 11,000,000 and the polymer is 30% hydrolyzed. The polymer concentration in the gelation solution is 3,000 ppm. The ratio of polymer to chromic acetate complex in the gelation solution is about 5:1.

4180 barrels (668 $m^3$) of the flowing gelation solution are pumped into the dead volume of the tank via the outlet port. The solution is cured for 48 hours at an ambient temperature of 21° C. to form a rigid gel.

Thereafter, the tank is restored to operation by filling it with 95,820 barrels (15,332 $m^3$) of gasoline.

The tank is operated for two years without contamination of any stored gasoline by the gel nor is any degradation of the gel by the gasoline detected.

While the foregoing preferred embodiment of the invention has been described and shown, it is understood that all alternatives and modifications, such as those suggested and others, may be made thereto and fall within the scope of the invention.

I claim:

1. A process for storing a refined liquid hydrocarbon product in a storage tank "having a dead volume" between the bottom of said tank and an outlet port in said tank, said process comprising:

preparing a gelation solution comprising an aqueous liquid solvent, an acrylamide polymer and a crosslinking agent containing a polyvalent metal cation selected from the group consisting of aluminum, chromium and mixtures thereof, said gelation solution capable of forming a rigid crosslinked polymer gel which is substantially insoluble and inert in said refined liquid hydrocarbon product;

placing said solution in said dead volume;

gelling said solution substantially to completion in said dead volume to produce said rigid gel which substantially fills said dead volume; and storing said refined liquid hydrocarbon product in said storage tank in contact with said gel without substantially contaminating said product with said gel and without substantially degrading said gel.

2. The process of claim 1 wherein said crosslinking agent is a chromic acetate complex.

3. The process of claim 1 wherein said acrylamide polymer is selected from the group consisting of polyacrylamide and partially hydrolyzed polyacrylamide.

4. The process of claim 1 wherein said refined liquid hydrocarbon product is selected from the group consisting of gasoline, diesel, kerosene, and fuel oil.

5. The process of claim 1 wherein said refined liquid hydrocarbon product is gasoline.

6. The process of claim 1 wherein said dead volume is between about 1% and 6% of the total internal volume of said tank.

7. The process of claim 1 further comprising withdrawing said stored refined liquid hydrocarbon product stored from said tank via said outlet port while said rigid gel remains in said dead volume.

8. The process of claim 1 further comprising removing said rigid gel from said dead volume by contacting said gel with a chemical agent which substantially degrades said gel to a flowing solution.

9. The process of claim 8 wherein said chemical agent is hydrogen peroxide.

10. The process of claim 1 wherein said storage tank has a total internal volume between about 10,000 and 500,000 barrels.

11. The process of claim 1 wherein said gelation solution further comprises an aqueous liquid contaminant present in said dead volume which dissolves in said solution when said solution is placed in said dead volume.

12. The process of claim 7 wherein the volume of said gelation solution which is placed in said dead volume is sufficient to produce a volume of said rigid gel which is substantially equal to said dead volume.

* * * * *

UNITED STATES PATENT AND TRADEMARK OFFICE

CERTIFICATE OF CORRECTION

PATENT NO. : 5,172,825

DATED : December 22, 1992

INVENTOR(S) : Carl D. Clay

It is certified that error appears in the above-identified patent and that said Letters Patent is hereby corrected as shown below:

Col. 7, line 13: Delete " "having a dead volume" " and insert therefor --having a dead volume--

Signed and Sealed this

Seventh Day of December, 1993

*Attest:*

*Attesting Officer*

Bruce Lehman

BRUCE LEHMAN

*Commissioner of Patents and Trademarks*